US005984486A

United States Patent [19]

Munz et al.

[11] Patent Number: 5,984,486

[45] Date of Patent: Nov. 16, 1999

[54] TASK LIGHT SHELF SYSTEM

[75] Inventors: Willi Munz, San Francisco; Douglas J. Herst, Ross, both of Calif.

[73] Assignee: NSI Enterprises, Inc., Atlanta, Ga.

[21] Appl. No.: 08/754,099

[22] Filed: Nov. 20, 1996

Related U.S. Application Data

[63] Continuation of application No. 08/431,987, May 1, 1995.

[51] Int. Cl.[6] ..... F21V 13/00

[52] U.S. Cl. ..... 362/33; 362/127; 362/370; 211/153; 211/186; 211/90

[58] Field of Search ..... 362/123, 33, 370; 108/23; 211/153, 186, 175, 90, 134

[56] References Cited

U.S. PATENT DOCUMENTS

| | | | |
|---|---|---|---|
| 1,963,477 | 6/1934 | Stein | 362/127 |
| 3,997,776 | 12/1976 | Ruud | 362/127 |
| 4,164,009 | 8/1979 | Maguire et al. | 362/127 |
| 4,617,612 | 10/1986 | Pritchett | 362/33 |
| 5,079,680 | 1/1992 | Kohn | 362/127 |
| 5,226,719 | 7/1993 | Feldpausch et al. | 362/127 |
| 5,359,503 | 10/1994 | Myodo et al. | 362/127 |

*Primary Examiner*—Ira S. Lazarus
*Assistant Examiner*—Alfred Basichas
*Attorney, Agent, or Firm*—Donald L. Beeson

[57] ABSTRACT

A task light shelf system provide a task light having an elongated housing with a planar top wall structure that acts as a shelf surface. The housing of the task light has sufficient structural strength to carry loads on the shelf surface and is supported over a task area by means of angle brackets that attach to attachment slots formed in the top wall of the task light. Extended shelf surfaces can be provided by means of insert elements and angle brackets having extended attachment arms, which attach to the extended arms of the angle brackets. The insert elements can be optionally closed channel members to provide wire or cable channels behind the task light.

16 Claims, 5 Drawing Sheets

29
32
30

24
25
30

13
19
27
24
25
31
29
23
27
31
25
24
14
16
29
21
103

TASK LIGHT SHELF SYSTEM

This application is a continuation of application Ser. No. 08/431,987, filed May 1, 1995 now abandoned.

BACKGROUND OF THE INVENTION

The present invention relates to task lighting generally, and more particularly to task lighting used in environments where shelf space is desirable, such as in office furniture systems, laboratories, library reading areas, and the like.

It is well known to mount task lights beneath shelving, binder bins, and other structures already existing in a work or other visual task environment. Such task lights are intended to provide task lighting to a task area beneath the structure to which it is mounted, and to serve no other function. Indeed, such task lights are largely hidden from view, and therefore do not contribute to the architecture of the working area. The need for shelving is normally provided by separate furniture elements or mill work to which a task light may be attached.

There is a need to provide task environments with shelving space and task lighting without the need to mount task lights to structural elements extending over the task area. The present invention fulfills this need by providing a task light shelf system wherein the task lighting and shelving needs of a task area can be satisfied by the task light structure alone.

SUMMARY OF THE INVENTION

Briefly, the invention involves a task light shelf system comprised of a task light having an elongated housing with a top wall structure that provides a planar shelf surface along the top of the housing, and a bottom opening for illuminating the task light area. Preferably, the housing, which must be of sufficient structural strength to support loads from articles placed on the housing's planar shelf surface, will have a shallow rectangular cross-sectional shape to simulate a flat shelf. It is contemplated that the housing will be constructed to achieve a load rating of at least about five pounds per lineal inch of shelf surface.

Support means for supporting the task light above the task area are provided, suitably in the form of angle bracket members or other support structures having horizontal attachment arms that extend over and attach to the top wall structure of the housing at suitable spaced intervals along the length of the housing. Support means can be provided for wall mounting the task light, for mounting the task light to the edge of a desk top or other horizontal surface, or for supporting the task light from a stand, or for suspending the task light. Preferably, the horizontal attachment arms attach to at least one, and preferably two parallel attachment slots formed lengthwise in the top wall structure of the housing. The attachment arms are adapted to attach to the attachment slots at any point along the length of the slots such that the positioning of the attachment arms along the task light housing is infinitely adjustable.

In a further feature of the invention, an insert is provided for extending the planar shelf surface of the task light and, optionally, for providing a wire channel at the back of the task light for handling any cabling and wiring requirements associated with the task light shelving structure.

Therefore, it is a primary object of the invention to provide a task lighting shelf system that provides task lighting to a task area as well as satisfying the need for shelving space over the task area. It is a further object of the invention to fulfill both of these needs with one easily installable system. It is still a further object of the invention to provide a task light shelf system that adapts to different installation environments and that is aesthetically pleasing. Yet other objects of the invention will become apparent from the following specification and claims.

DETAILED DESCRIPTION OF THE ILLUSTRATED EMBODIMENT

Figure 1:
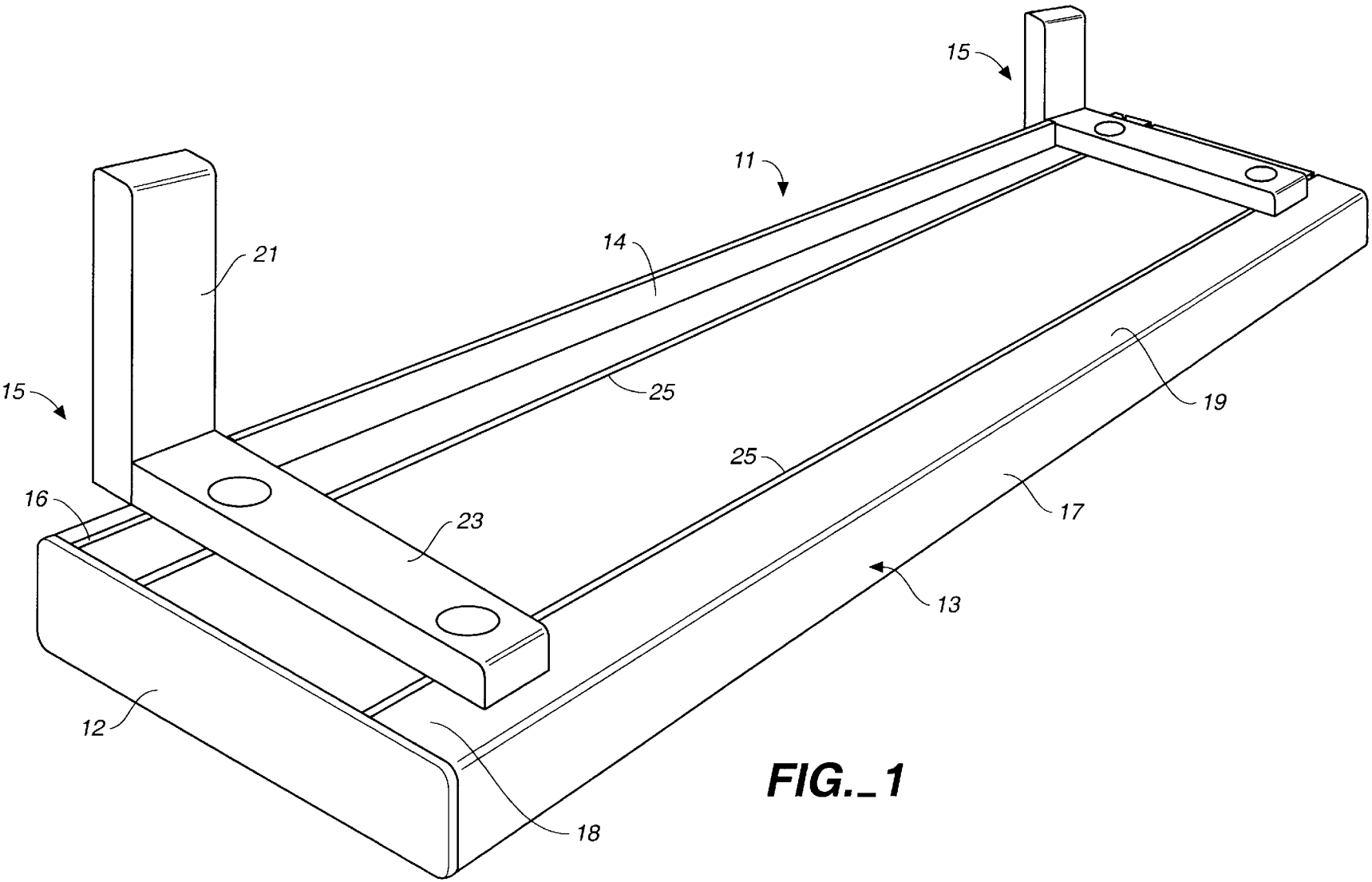
FIG. 1 is a top perspective view of a task light shelf system in accordance with the invention.
Figures 2, 2A, 2B:
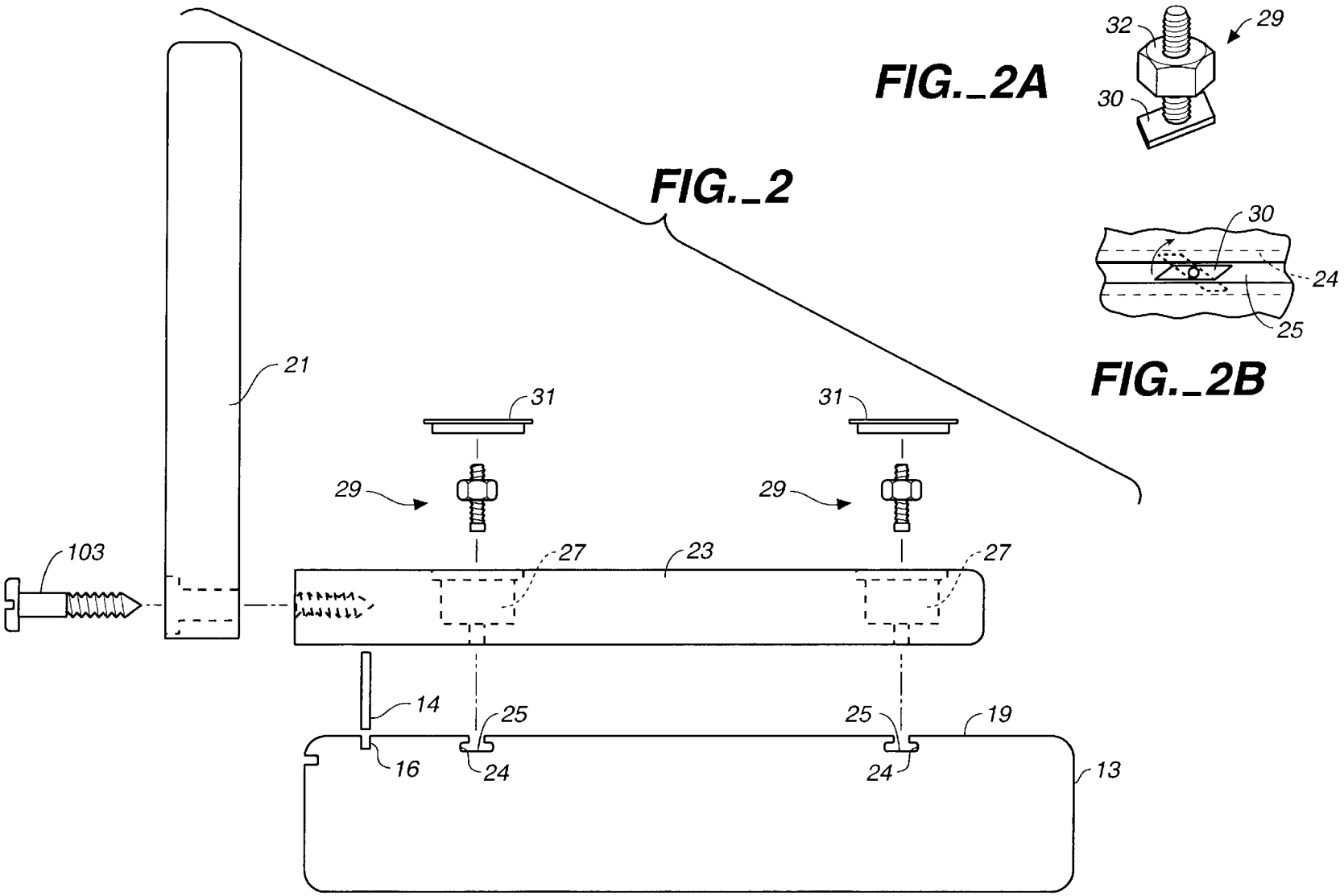
FIG. 2 is an exploded pictorial view inside elevational of the task light shelf system shown in FIG. 1.
FIG. 2A is a top perspective view of one of the slot fasteners shown in FIG. 2 for securing the horizontal attachment arm of the angle bracket member to the top of the task light.
FIG. 2B is a top perspective view of the slot fastener of FIG. 2A, showing the rotational engagement of the slot fastener lugs in the attachment slots of the task light housing.

Turning now to the drawings, FIGS. 1 and 2 show a task light shelf system 11 comprised of a task light 13 held above a task area by support means in the form of angle bracket members 15. The task light has an elongated housing 17 that provides a top wall structure 18 that in turn provides a planar shelf surface 19 atop the task light. A metal barrier strip 14 removably fits into slot 16 in the top wall of the housing to prevent small articles placed on the shelf from falling behind the shelf. The housing, which is seen to have a shallow rectangular cross-sectional shape that simulates the appearance of a shelf, can suitably be fabricated from an aluminum extrusion cut to a desired length, with the free ends of the extrusion being covered by end caps, such as end cap 12 shown in FIG. 1. The extrusion must have sufficient structural strength to support loads produced by articles, for example, books, placed on shelf surface 19. Preferably, to meet acceptable loading standards, the structural strength of the extrusion should be sufficient to support at least about five pounds per lineal inch of shelf surface.

Figure 3A:
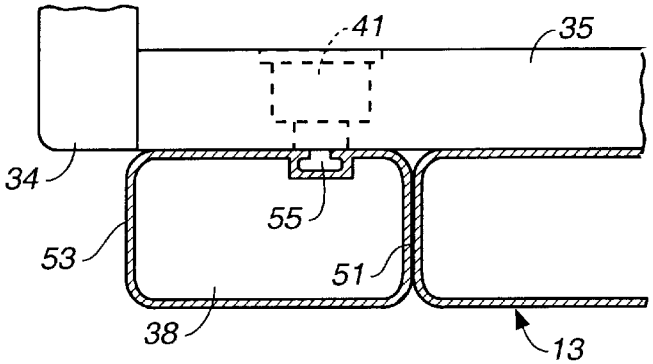
FIG. 3A is a side elevational view of an extended task light shelf system as shown in FIG. 3 with the insert member being a wire channel.
Figure 3:
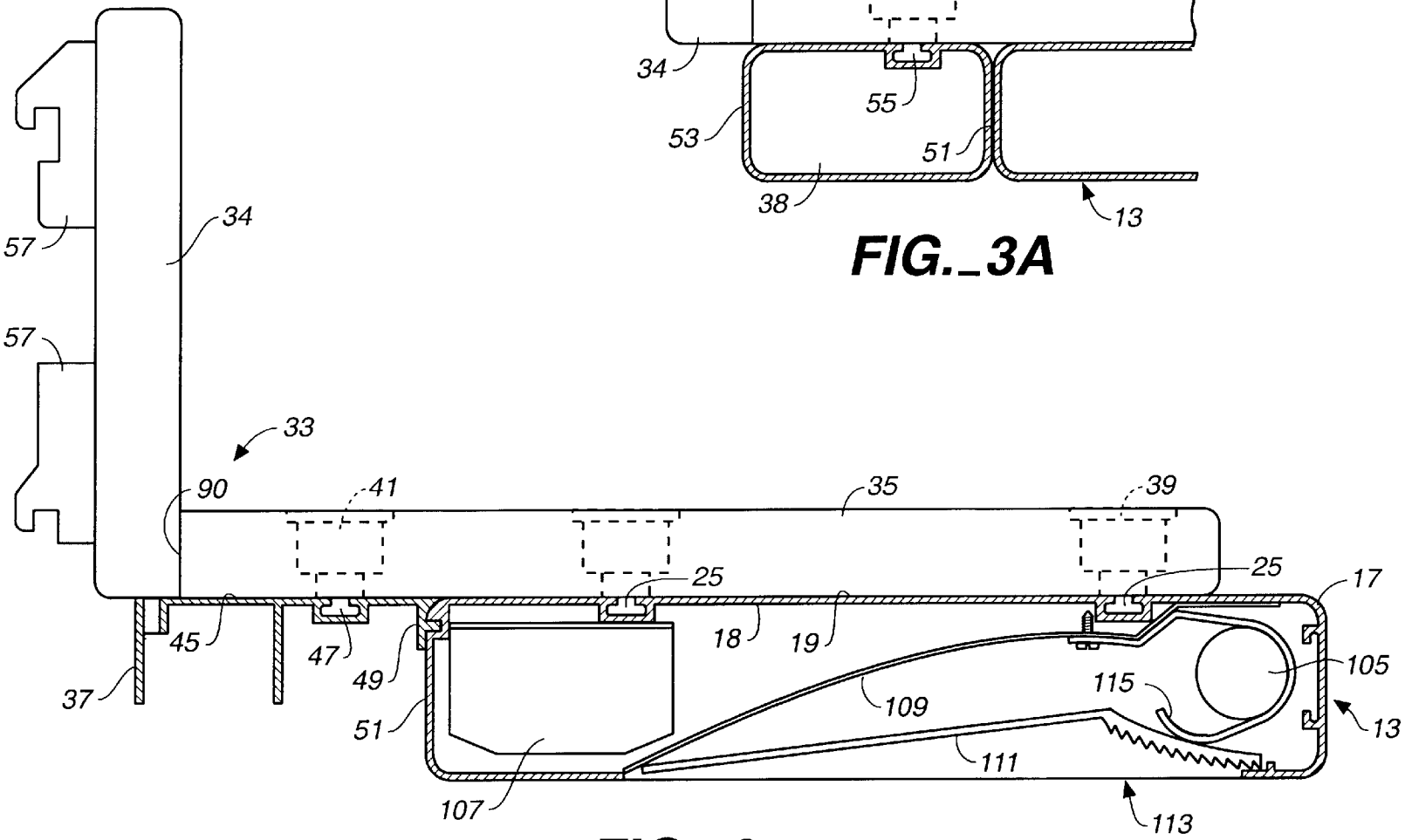
FIG. 3 is a side elevational view of an extended task light shelf system in accordance with the invention showing an interior insert element for extending the planar shelf surface and wherein the task light and insert element are shown in cross-section.

Referring to FIG. 3, task light 13 is seen to include a light source in the form of fluorescent lamp 105, a ballast 107, and an optical system comprised of reflector 109 and lens 111. Light from the light source is directed down through a bottom opening 113 in housing 17 onto task surfaces situated below the task light. Removal of the lamp is easily accomplished by means of the lamp remover strip 115 which is a resilient strip of material that also acts to hold lens 111 in place.

Bracket members 15 are comprised of two joinable parts, namely, vertical mounting arms 21 and horizontal attachment arms 23. The horizontal attachment arms have sufficient length to extend over most of the width of the top shelf surface of the task light housing and can be attached to the housing at attachment points anywhere along the housing's length. Thus, the spacing of the bracket members can be selected during installation depending on the mounting requirements.

More specifically, parallel attachment slots 25 in the form of extruded T-slots are provided in the housing's top wall structure and run longitudinally the length of the housing. The horizontal attachment arm 23 of each angle bracket members 15, in turn, has countersunk fastener openings 27 located in correspondence to the parallel attachment slots such that the arm can be fastened to the top of the housing as hereinafter described by slot fasteners 29. To provide a finished appearance to the task light shelf system, fastener opening plugs 31 cover fastener openings 27 after the task light has been installed.

The horizontal attachment arm of any angle bracket member can be attached and reattached anywhere along the length of attachment slots 25 and thus are adjustable, which will permit angle bracket members to be readily positioned in accordance with the requirements of a particular installation. For example, the angle bracket members can be readily positioned to match the spacing of wall studs or the spacing of partition walls where the angle bracket members are cleat-mounted at the partition wall junctions.

FIGS. 3–6 show an alternative embodiment of the angle bracket members of the task light shelf system of the invention. This embodiment can be used for extending shelf space and, if desired, for providing a channel at the back of the shelf for wiring and cabling. In FIGS. 3 and 3A, it is seen that task light 13 is held by extended angle bracket members, such as the extended angle bracket member 33, in the same manner as the embodiment shown in FIGS. 1 and 2, except that the extended horizontal attachment arm 35 of the extended angle bracket is longer than the width of the task light housing. The task light is attached to the outboard portion of the attachment arm such that an interior space is provided into which an interior insert element can be mounted. As hereinafter described, the insert element can be an open channel plate 37, as shown in FIG. 3, or a closed wire channel 38 as shown in FIG. 3A which can optionally have electrical outlets (not shown). Also described will be a construction for the extended horizontal attachment arm 35 which allows the arm to be cut by the installer to produce a short attachment arm as shown in FIGS. 1 and 2.

As shown in FIGS. 3–6, the extended attachment arm 35 has three fastener openings, namely, two outboard fastener openings 39, 39*a* and a single inboard fastener opening 41. The outboard fastener openings, which are used to secure the task light 13, are spaced to align with parallel attachment slots 25 in the top wall structure 18 of the task light housing; the single inboard fastener opening 41, on the other hand, which is used to secure the insert element, is spaced behind the interior edge 51 of the task light housing.

Referring to FIG. 3, the open channel plate 37, which like the task light housing is also suitably an extruded aluminum part, has a top wall 45 in which there is a single attachment slot in the form of extruded T-slot 47 running longitudinally the length of the channel and positioned to align with the inboard fastener opening 41 of the extended horizontal attachment arm. Open channel plate 37 has an interior edge 49 that mates with the task light housing's interior edge 51, such that the top wall 45 of the open channel plate extends the top shelf surface 19 of the task light housing without gaps in the extended surface.

Similarly, as shown in FIG. 3A, a closed channel member 53 can be provided to extend the shelf surface and to provide a wire or cabling channel behind the task light. The closed channel member would similarly be provided with an attachment T-slot 55 positioned relative to the inbound fastener opening 41 of the extended attachment arm, and would similarly mate with the interior edge 51 of the task light housing.

Figure 7:
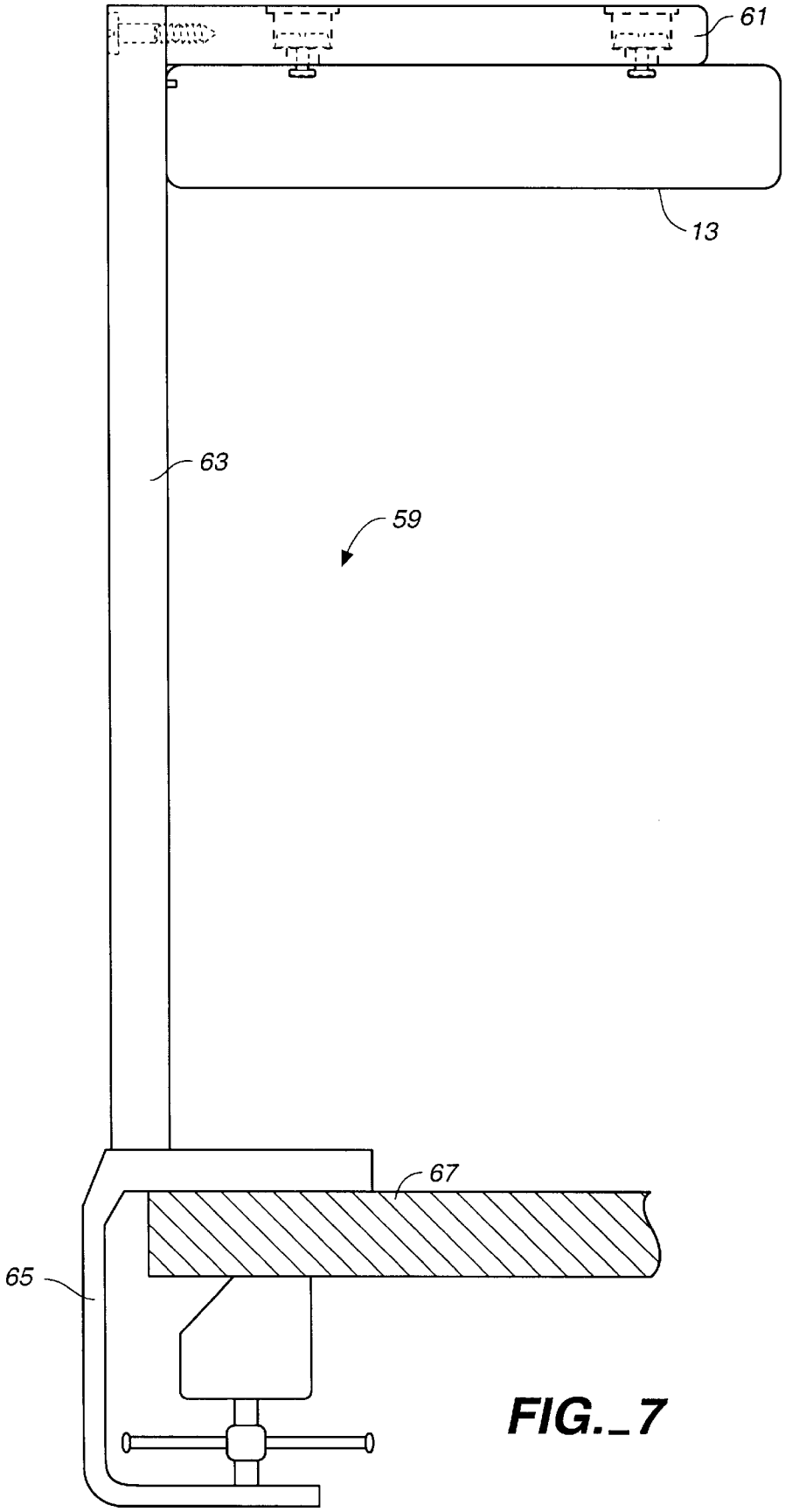
FIG. 7 is a side elevational view of a task light shelf system showing the task light mounted to the edge of a desk top surface.

It is noted that the vertical mounting arm 34 of the extended angle bracket 33 shown in FIGS. 3 and 3A is illustrated with metal cleats 57 of the type that can attach to slotted vertical channel brackets of the type conventionally provided at partition wall junctions of furniture systems and of the type used to wall mount bookshelves. This mounting system is intended to be simply exemplary of the number of possible mounting methods that can be used to support the task light shelf system over a task area. For example, in FIG. 7, the task light 13 is supported from an angle bracket member 59 comprised of a short horizontal attachment arm 61, a relatively long vertical mounting arm 63 and a clamp 65 at the bottom of the vertical mounting arm for clamping the task light to the edge of tabletop 67. Other examples of means for supporting task lights above the task area would include a floor-standing unit having an angle bracket member with a floor length vertical mounting arm and stand, and a suspension structure where horizontal attachment arms such as heretofore described are suspended from an overhead ceiling surface, such as by a vertical mounting arm or suspension cables.

Figure 4:
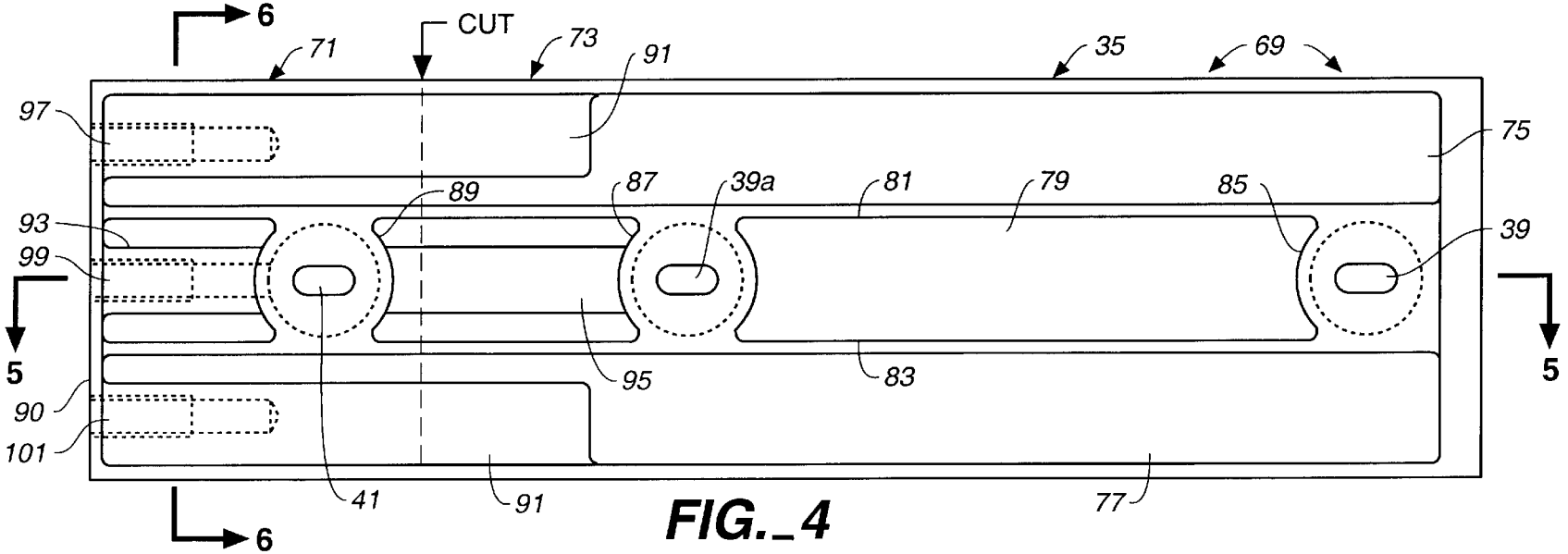
FIG. 4 is a bottom plan view of an extended horizontal attachment arm of the angle bracket member used to support the task light.
Figure 5:
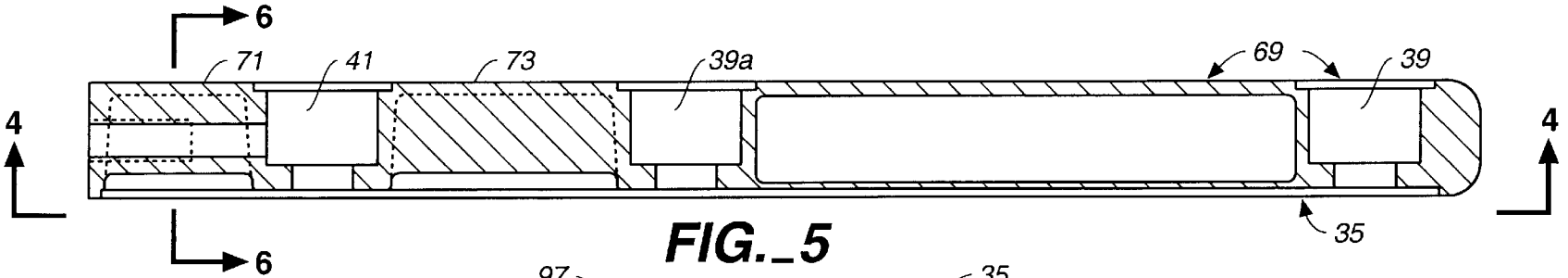
FIG. 5 is a cross-sectional view thereof taken along lines 5—5 of FIG. 4.
Figure 6:
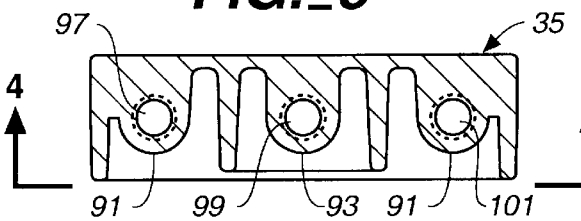
FIG. 6 is a cross-sectional view thereof taken along lines 6—6 of FIG. 4.

Turning to the construction of the extended horizontal attachment arm illustrated in FIGS. 4–6, this attachment arm can generally be defined as having outboard portion 69 containing the outboard fastener openings 39, 39*a*, inboard portion 71 containing the inboard fastener opening 41 for attaching the insert member as heretofore described, and a bridge portion 73 generally extending between outboard fastener opening 39*a* and inboard fastener opening 41. To reduce materials cost and weight, the bottom of the arm is provided with cavity regions, such as cavity regions 75, 77, 79 in the outboard portion of the arm. Strengthening ribs, such as ribs 81, 83, are formed within these cavity regions, as are circular bosses 85, 87, 89 in which the fastener openings are formed. Additionally, opposed lateral bosses 91 extend from the interior edge 90 of the arm to span the inboard and bridge portions of the arm. An elongated interior boss 93 still further connects the interior edge 90 to the inboard circular boss 89 while a second central boss 95 interconnects circular interior boss 89 with the outboard circular boss 87.

The lateral and central bosses 91, 93, 95 are to provide material in which threaded holes 97, 99, 101 can be tapped for bolting the interior edge 90 of the horizontal arm to the vertical arm as hereinafter described. It can be seen that by extending the lateral bosses into the bridge portion of the arm and by providing a central boss 95 in this same bridging portion, the arm can be shortened by cutting the arm through the bridging portion as shown by the arrow denoted "cut" and redrilling the threaded bolt holes in what remains of the lateral and central bosses. In this manner, a single part can be provided which can be adapted to both a standard shelf size and an extended shelf size.

To describe the assembly of a task light shelf system in accordance with the invention, reference is made to the embodiment shown in FIGS. 2 and 3. The angle bracket member is first assembled by attaching the vertical mounting arm 34 to the interior end 90 of the horizontal attachment arm 35 by means of lag screw (such as lag screw 103 shown in FIG. 2). When the required number of angle bracket members are thusly assembled, and after the angle brackets have been mounted to a wall or other structure in a position that suitably places the task light shelf system over the task area, the task light can be fastened to the angle brackets. This is achieved by first holding task light 13 against the bottom of the outbound portion of the extended attachment arms 35 of the angle brackets so that the outboard fastener openings of the arm 39, 39*a* align with attachment slots 25 in the top wall structure of the task light housing. The trapezoidal lug portions 30 of the slot fasteners 29 (shown in FIGS. 2A and 2B) are then, with the lugs rotated lengthwise relative to the slots, inserted through the arm's fastener openings and into the attachment slots. Once inserted the nut portion 32 of the slot fastener is tightened with a socket wrench causing the lug to rotate and engage the sidewalls 24 of the slot as illustrated in FIG. 2B. After the task light is fastened at each attachment point, fastener opening plugs 31 are pressed into the tops of the fastener openings in order cover these openings.

If an extended shelf system is used as illustrated in FIG. 3, the open channel plate 37 or closed wire channel 53 is additionally secured to the bottom of the horizontal attachment arms in the same manner as the task light.

While the present invention has been described in considerable detail in the foregoing specification, it should be understood that it is not intended that the invention be limited to such detail, except as necessitated by the following claims.

What I claim is:

1. A task light shelf system comprising a task light having an elongated enclosed housing and a bottom opening in said housing for illuminating a task area below said task light, said housing having an integral top wall structure that provides a planar shelf surface along the top of said housing and being of sufficient structural strength to support loading thereon due to articles placed on said planar shelf surface, and support means attachable to said housing for supporting said task light above a task area for providing illumination to the task area in combination with a shelf above the task area.

2. The task light shelf system of claim 1 wherein the housing of said task light has a shallow rectangular housing to simulate the overall appearance of a flat shelf.

3. The task light shelf system of claim 1 wherein said task light housing has a structural strength to support at least about five pounds per lineal inch of shelf surface.

4. The task light shelf system of claim 1 wherein said support means includes at least two angle bracket members attachable at spaced intervals to the housing of said task light for mounting said task light to a support structure.

5. A task light shelf system comprising a task light having an elongated housing and a bottom opening in said housing for illuminating a task area below said task light, said housing having a top wall structure that provides a planar shelf surface along the top of said housing and being of sufficient structural strength to support loading thereon due to articles placed on said planar shelf surface, and support means for supporting said task light above a task area for providing illumination to the task area in combination with a shelf above the task area, said support means including at least two angle bracket members for mounting said task light to a support structure, each of said angle bracket members having a horizontal attachment arm for extending over and attaching to the top wall structure of said housing at spaced intervals along said housing.

6. The task light shelf system of claim 5 wherein said housing has selectable attachment points along the length of its top wall structure, the horizontal attachment arm of any said angle bracket member being adapted to positionably attach to the top wall structure of said housing at any one of said selectable attachment points.

7. The task light shelf system of claim 5 wherein said housing has at least one attachment slot formed lengthwise in the top wall structure thereof, the horizontal attachment arm of any said angle bracket member being adapted to attach to the attachment slot in the top wall structure of said housing at any point along the length thereof such that the position of the angle bracket member along the task light housing is adjustable along said top wall structure.

8. The task light shelf system of claim 7 wherein at least two parallel attachment slots are formed lengthwise in the top wall structure of said housing.

9. The task light shelf system of claim 5 wherein the housing of said task light has a defined interior edge, the task light shelf system further comprises an interior insert element that mates with the interior edge of said housing so as to extend the shelf surface thereof, and the horizontal attachment arms of said angle bracket members extend over and attach to both said interior insert element and the top wall structure of said task light housing for providing an extended shelf surface above the task area.

10. The task light shelf system of claim 9 wherein said insert element is a closed channel element which serves as a wire channel.

11. A task light shelf system comprising a task light having an elongated housing and a bottom opening in said housing for illuminating a task area below said task light, said housing having a top wall structure that provides a planar shelf surface and a shallow rectangular cross-sectional shape to simulate the overall appearance of a flat shelf, said housing further being of sufficient structural strength to support loading thereon due to articles placed on said planar shelf surface, said top wall structure including selectable attachment points along its length, and at least two angle bracket members for mounting said task light above a task area for providing illumination to the task area in combination with a shelf above the task area, each of said angle bracket members having a horizontal attachment arm for extending over and attaching to any selectable attachment point along the length of the top wall structure of the housing of said task light.

12. The task light shelf system of claim 11 wherein the attachment points in the top wall structure of said housing include at least one attachment slot formed lengthwise in the top wall structure thereof, the horizontal attachment arm of any said angle bracket member being adapted to attach to the attachment slot in the top wall structure of said housing at any point along the length thereof such that the position of the angle bracket member along the task light housing is adjustable along said top wall structure.

13. The task light shelf system of claim 12 wherein the attachment points in the top wall structure of said housing include at least two parallel attachment slots formed lengthwise in the top wall structure thereof, the horizontal attachment arm of any said angle bracket member being adapted to attach to each of the attachment slots in the top wall structure of said housing at any point along the length thereof whereby the position of the angle bracket member along the task light housing is infinitely adjustable.

14. The task light shelf system of claim 13 wherein said task light housing has a structural strength to support at least about five pounds per lineal inch of shelf surface.

15. A task light shelf system comprising a task light having an elongated housing and a bottom opening in said housing for illuminating a task area below said task light, said housing having a top wall structure that provides a planar shelf surface and a shallow rectangular cross-sectional shape to simulate the overall appearance of a flat shelf, said housing further being of sufficient structural strength to support loading thereon due to articles placed on said planar shelf surface, at least one longitudinal attachment slot in the top wall structure of said task light housing, said attachment slot being in the form of a T-slot having T-slot sidewalls, at least two angle bracket members for mounting said task light above a task area for providing illumination to the task area in combination with a shelf above the task area, each of said angle bracket members having a horizontal attachment arm for extending over, a fastener opening in the horizontal attachment arm of each of said angle bracket members, said fastener opening being alignable with the attachment slot of said task light housing, and a slot fastener for each fastener opening in said horizontal attachment arm for rotatably locking said attachment arm to the attachment slot of said task light housing.

16. The task light shelf system of claim 15 wherein said slot fastener has a trapezoidal lug for fitting into and rotationally engaging said T-slot sidewalls when said fastener is tightened.

* * * * *